US011208784B2

(12) United States Patent
Molnar

(10) Patent No.: US 11,208,784 B2
(45) Date of Patent: Dec. 28, 2021

(54) QUICK CHANGE COUPLING APPARATUS AND METHOD

(71) Applicant: Timothy Molnar, Stow, OH (US)

(72) Inventor: Timothy Molnar, Stow, OH (US)

( * ) Notice: Subject to any disclaimer, the term of this patent is extended or adjusted under 35 U.S.C. 154(b) by 1054 days.

(21) Appl. No.: 15/783,830

(22) Filed: Oct. 13, 2017

(65) Prior Publication Data

US 2018/0106012 A1 Apr. 19, 2018

Related U.S. Application Data

(60) Provisional application No. 62/408,472, filed on Oct. 14, 2016, provisional application No. 62/416,981, filed on Nov. 3, 2016.

(51) Int. Cl.
*E02F 3/36* (2006.01)

(52) U.S. Cl.
CPC ..... *E02F 3/364* (2013.01); *E02F 3/3686* (2013.01)

(58) Field of Classification Search
CPC ..... E02F 3/3636; E02F 3/3631; E02F 3/3622; E02F 3/3672; E02F 3/364; E02F 3/3686; E02F 3/3668
See application file for complete search history.

(56) References Cited

U.S. PATENT DOCUMENTS 3,672,521 A * 6/1972 Bauer ..... E02F 3/3672 414/723
3,896,884 A * 7/1975 Casey ..... E02F 3/36 172/776
3,985,249 A 10/1976 Aker et al.
4,708,579 A 11/1987 Baird et al.
5,108,252 A * 4/1992 Gilmore, Jr. ..... E02F 3/364 414/694
5,415,235 A 5/1995 Gebauer
6,074,120 A 6/2000 Williams
6,312,212 B1 11/2001 Burlew, Jr.
6,422,805 B1 7/2002 Miller
6,699,001 B2 3/2004 Fatemi
(Continued)

FOREIGN PATENT DOCUMENTS

EP 278571 8/1988
EP 2987916 8/2015
(Continued)

OTHER PUBLICATIONS

ACS Industries, Inc., Quick Coupler Systems for Loaders.
Caterpillar, Cat Fusion Coupler System H-Series.
Caterpillar, Cat Fusion Coupler System Wheel Loaders.

*Primary Examiner* — Daniel J Wiley
(74) *Attorney, Agent, or Firm* — Emerson, Thomson & Bennett, LLC; Roger D. Emerson

(57) ABSTRACT

Provided is a coupling apparatus including: an arrangement for attaching the coupler to an associated vehicle with at least one hydraulic cylinder and hydraulically driven wedge, and a pair of cutouts wherein the hydraulic cylinder drives the wedge between an upper mounting bracket and an adaptor installed in a lower mounting bracket of an implement. The provided adaptor includes: a pin with a first opening, a threaded pin with a second opening and a cap bolt inserted through the pin and into the threaded pin and secured thereto thus securing the attachment of the pin and threaded pin to the lower mounting bracket of an implement to be secured.

14 Claims, 5 Drawing Sheets

(56) References Cited

U.S. PATENT DOCUMENTS

| | | | | |
|---|---|---|---|---|
| 6,962,475 | B2 | 11/2005 | Fatemi | |
| 7,168,908 | B2 | 1/2007 | Diaz et al. | |
| 7,182,546 | B1 | 2/2007 | Kimble | |
| D565,062 | S | 3/2008 | Miller et al. | |
| 7,686,532 | B2 | 3/2010 | Kimble | |
| 7,814,689 | B2 | 10/2010 | Vering et al. | |
| 7,837,169 | B2 * | 11/2010 | Denis | F16F 1/38 248/316.8 |
| 7,882,898 | B1 | 2/2011 | Vering et al. | |
| 7,984,575 | B2 | 7/2011 | Robl et al. | |
| 7,984,576 | B2 | 7/2011 | Miller et al. | |
| 8,112,914 | B2 | 2/2012 | Miller et al. | |
| 8,448,357 | B2 | 5/2013 | Miller et al. | |
| 8,469,623 | B2 | 6/2013 | Luyendijk et al. | |
| 8,585,345 | B2 | 11/2013 | Sikorski et al. | |
| 8,684,623 | B2 | 4/2014 | Robl et al. | |
| 8,833,480 | B2 | 9/2014 | Grimes et al. | |
| 8,869,437 | B2 | 10/2014 | Robl et al. | |
| 8,974,137 | B2 | 3/2015 | Parker et al. | |
| 9,228,314 | B2 | 1/2016 | Robl et al. | |

FOREIGN PATENT DOCUMENTS

| | | |
|---|---|---|
| WO | 2008029112 | 3/2008 |
| WO | 2008031590 | 3/2008 |

* cited by examiner

QUICK CHANGE COUPLING APPARATUS AND METHOD

This application claims the benefit of U.S. Provisional Appl. No. 62/408,472, filed on Oct. 14, 2016 and also claims the benefit of U.S. Provisional Appl. No. 62/416,981, filed on Nov. 3, 2016, both of which are incorporated by reference as if fully rewritten herein.

TECHNICAL FIELD

The present disclosure relates to an apparatus for coupling and attachment to a front end loader, wheel loader, or a similar construction vehicle. More particularly, the present disclosure is directed at a quick change coupler and adaptor that allows for rapid attachment and detachment of an implement to or from an associated construction vehicle.

BACKGROUND

Heavy construction and earth moving operations often involve heavy machinery, such as a front end loader, wheel loader, backhoe, or the like. During the operation of these machines, it is often desirable to change attachments depending on what is needed to complete the job. For example, a wheel loader operator may need a grapple basket for one portion of a job and later need a bucket or utility forks to complete the job.

Without some form of quick change coupling apparatus, switching these implements could involve the need for other heavy equipment, and can take considerable time. Additionally, it would require the operator to leave the cab to connect and disconnect the implements which increases the time needed for the changeover, as well as exposes the operator to dangers outside of the cab.

Prior attempts to create a quick change coupler include the industry standard interchange that consists of two main components. First, disposed on the rearward face (or coupling face) of the implement, is a mounting bracket consisting of a series of ribs having upper hooks and lower openings. The second component is permanently installed on the associated vehicle and in its most basic form includes a cross member at the top to engage the hooks on the implement and one or more horizontally placed hydraulic pistons which can drive a pin through the lower openings and lock the implement in place.

This design allows for quick changes between implements, but is not without its shortcomings. First, all implements must have the requisite mounting brackets. Second, the action of inserting and removing the pin into and out of the openings necessarily results in wear, which, over time, can cause the pin to be reduced in size while the size of the opening increases. This wear can cause "slop" or extra space between the pin and the edges of the opening, which in turn can result in loose connection, ultimately leading to breakage and failure of one or both components. Finally, the increased slop can also lead to impact loading when the implement is used, which can cause damage and can make the operation less efficient.

Solutions to this wear problem involve welding the opening shut and re-drilling at the proper size, while replacing the pins as well. This solution is time consuming, often requiring the equipment to be taken out of service for multiple days. It is also merely a stop gap solution as the welds can often wear faster than the original materials.

Other solutions have including changing the design of the mounting bracket and coupler to a wedge design, where instead of pin, wedges are hydraulically driven along a vertical plane to secure the implement at the top and bottom. The problem with this design is that it is not backwards compatible with existing equipment, and cannot be easily modified to work with existing equipment. Thus, the thousands, if not hundreds of thousands, of implements that are configured for the first design would need to be replaced to adopt this alternate design and would result in a huge expense for owners and operators of such equipment. Additionally, operators would need time to replace their equipment and additional time to learn the operation of the new design. This would result in additional down time where the equipment and/or operators are taken out of service.

What is needed is a design that is able to be retro-fitted to the existing equipment, but does not suffer from the same defect of wearing out the pins and enlarging the openings to the point of failure.

SUMMARY

Provided is a coupling apparatus including: an arrangement for attaching the coupler to an associated vehicle on a first side; at least one hydraulic cylinder; at least one hydraulically driven wedge; and, a first cutout and a second cutout; wherein the hydraulic cylinder drives the wedge between an upper mounting bracket and an adaptor installed in a lower mounting bracket of an implement. The adaptor includes: a pin; wherein the pin further defines a first opening, a threaded pin; wherein the threaded pin further defines a second opening and a cap bolt; wherein the pin is installed on the outer side of a lower mounting bracket of an implement, the threaded pin is installed on the inner side of the lower mounting bracket, the second opening in the threaded pin is sized to accept at least a portion of the cap bolt; and the cap bolt is inserted through the pin and into the threaded pin and secured thereto thus securing the attachment of the pin and threaded pin to the lower mounting bracket of the implement.

DETAILED DESCRIPTION

Figure 1:
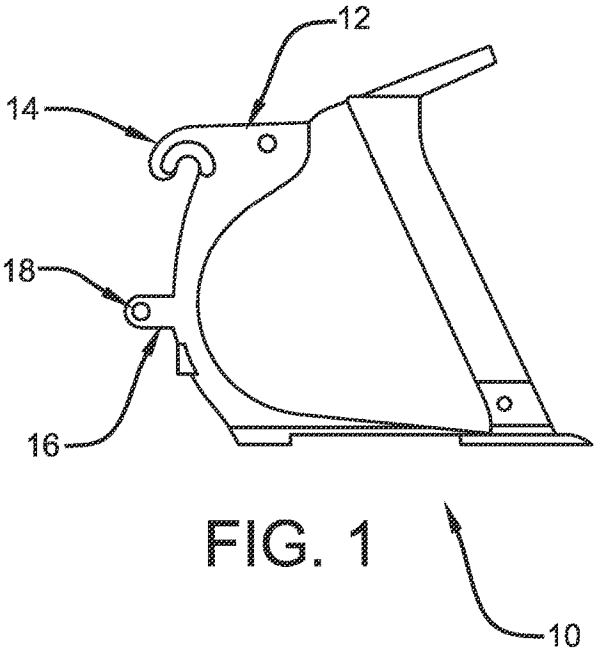
FIG. 1 is a side view of a prior art bucket.

With reference to FIG. 1, a prior art implement 10 is shown from the side. Although shown as a bucket, implement 10 could be any other known implement, including but not limited to grapple baskets, utility forks, scoops, brushes, blades, plows, recessed buckets, dump buckets, rakes, and/or booms. Installed on the rearward face of the bucket 10 is one or more mounting brackets 12. Each mounting bracket 12 is a vertical support member having an upper hook 14 and lower arm 16 with an opening 18 that extends through the arm 16.

Figure 2A:
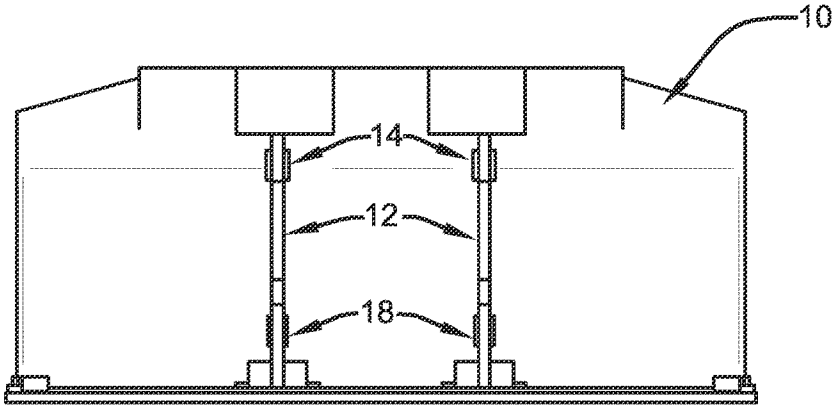
FIG. 2A is rear view of the prior art bucket.
Figure 2B:
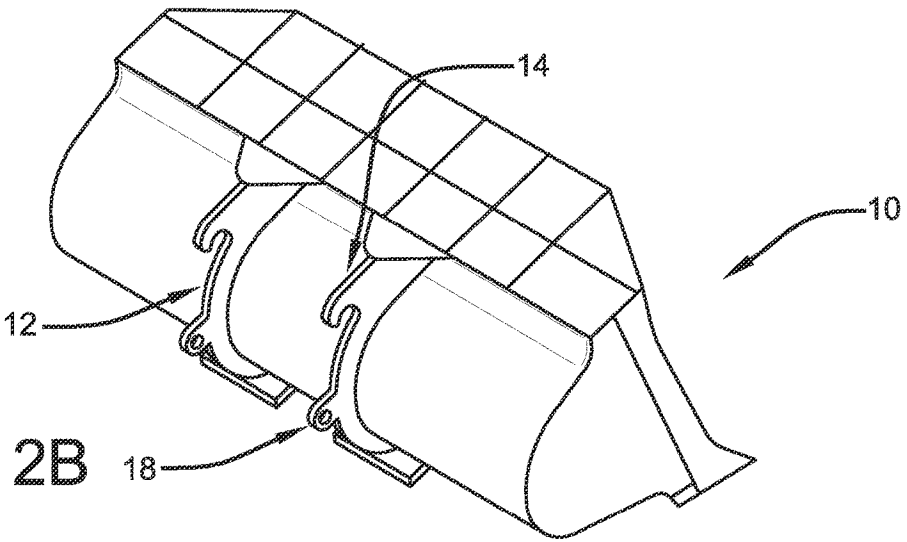
FIG. 2B is perspective view of the prior art bucket.

With reference to FIGS. 2A and 2B, the most common, and accepted industry standard, configuration of mounting brackets 12 on the rear of the implement 10 is two spaced brackets 12, each having a separate hook 14 and opening 18.

Figure 3:
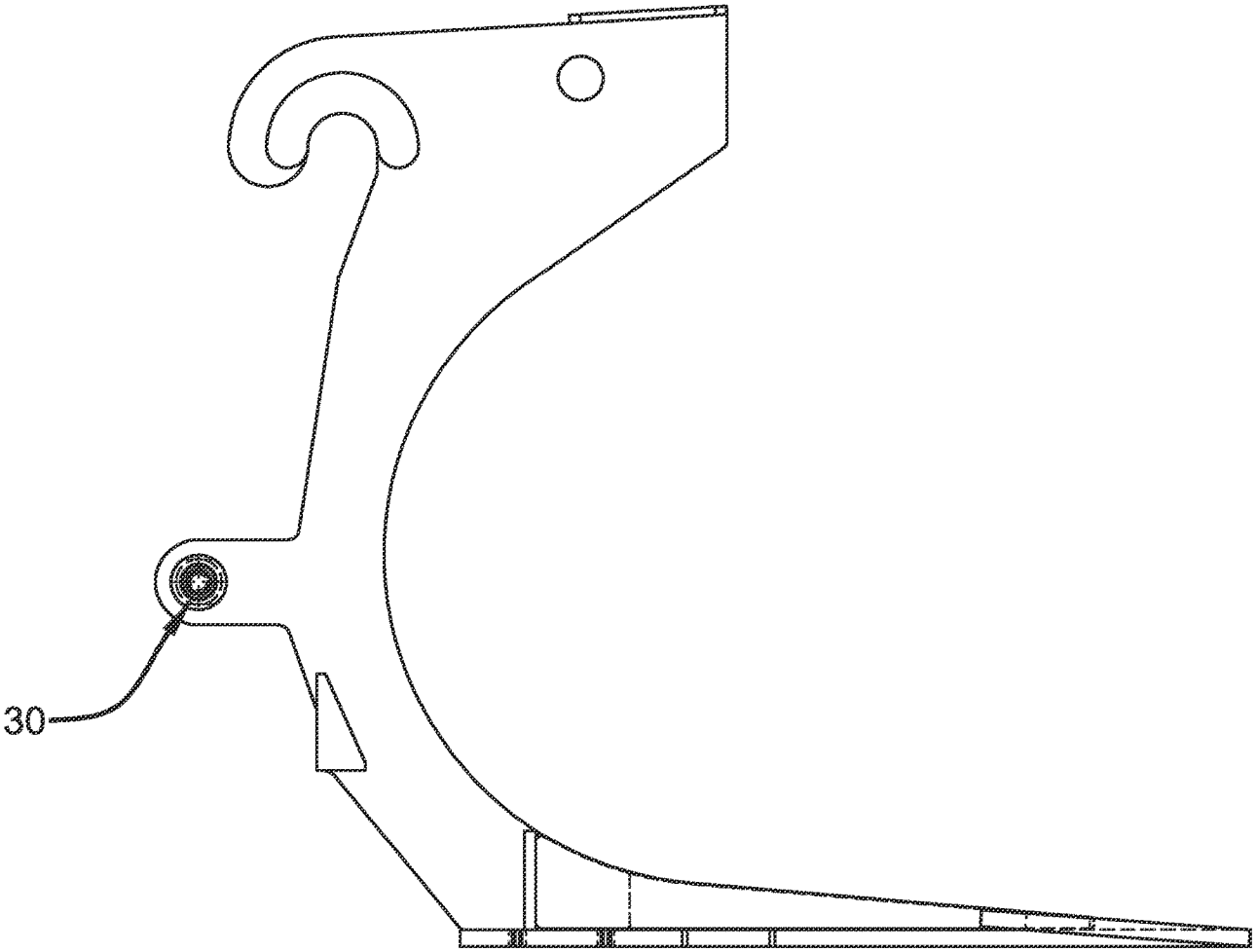
FIG. 3 is a side view of the prior art bucket with the present adaptor installed.
Figure 4:
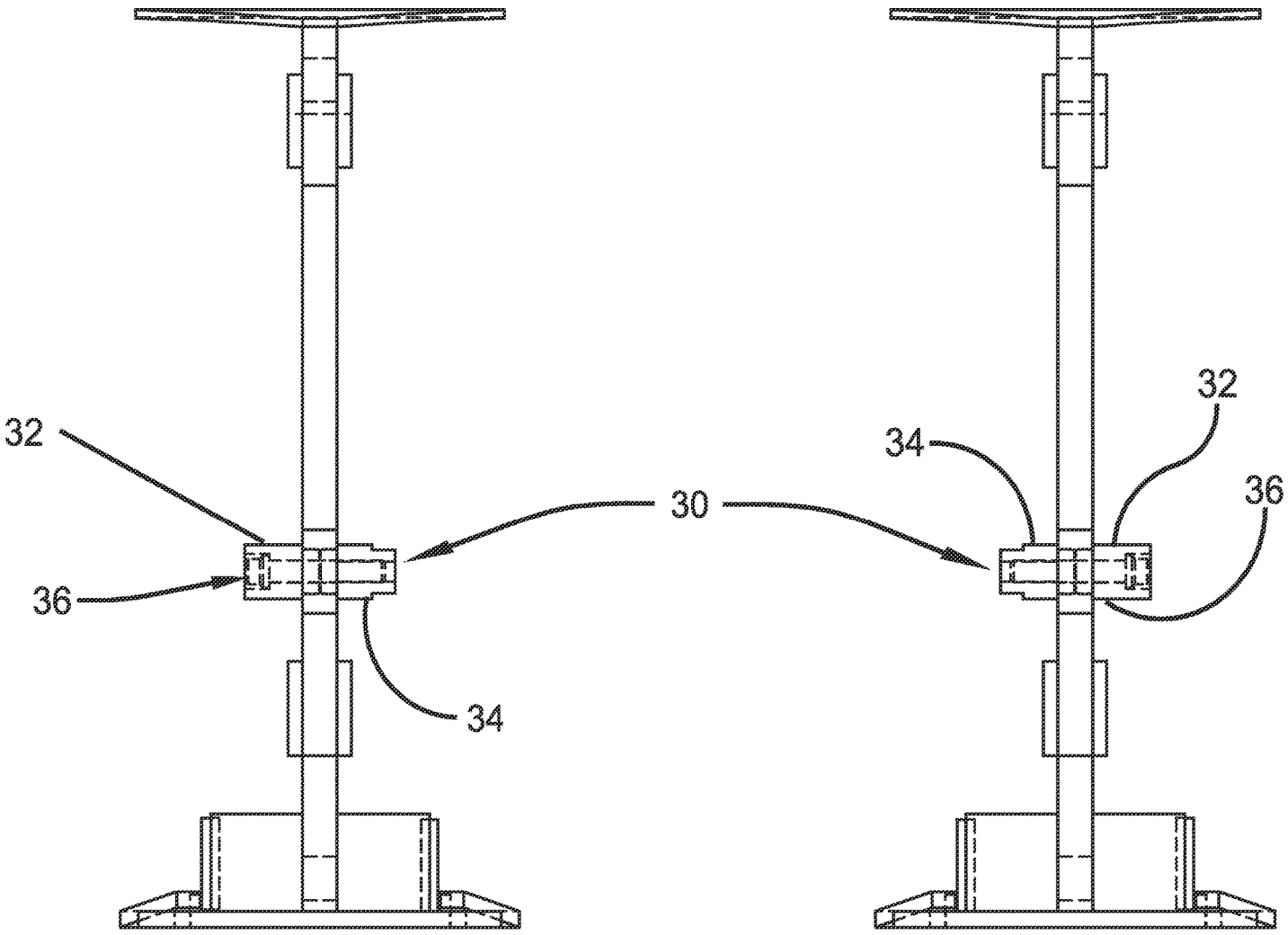
FIG. 4 is a rear view of the mounting bracket of the prior art bucket with the present adaptor installed.

With reference to FIGS. 3 and 4, adaptor 30 is installed through opening 18 (shown in FIG. 3 as shaded). Adaptor 30 consists of a pin 32, threaded pin 34 and cap bolt 36. According to the aspect shown, pin 32 is installed on the outer side of mounting bracket 12, while threaded pin 34 is installed on the inner side of mounting bracket 12. Cap bolt 36 in inserted within pin 32, extends through opening 18 and is threaded to threaded cap 34 to complete the installation of the adaptor 30. Threads are omitted from the drawings on both the cap bolt 36 and threaded pin 34 for clarity, but it is to be understood that according to this aspect, the threads are present and engaged with each other when cap bolt 36 is installed through pin 32 and into threaded pin 34.

Figure 6:
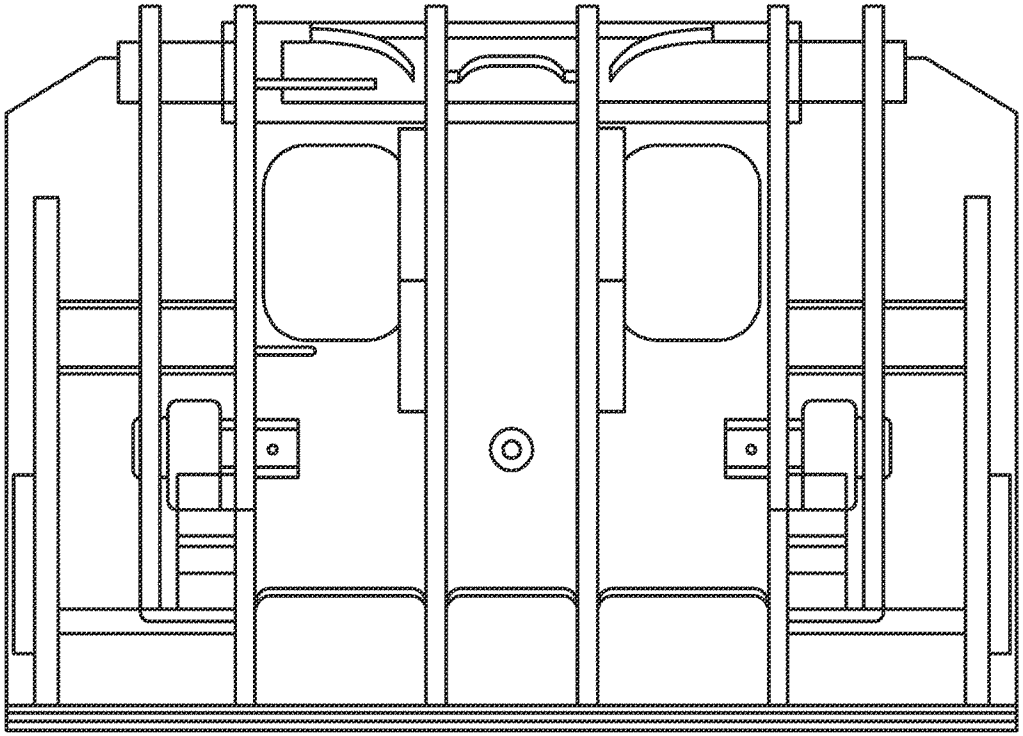
FIG. 6 is a rear view of a prior art coupling device.
Figure 5:
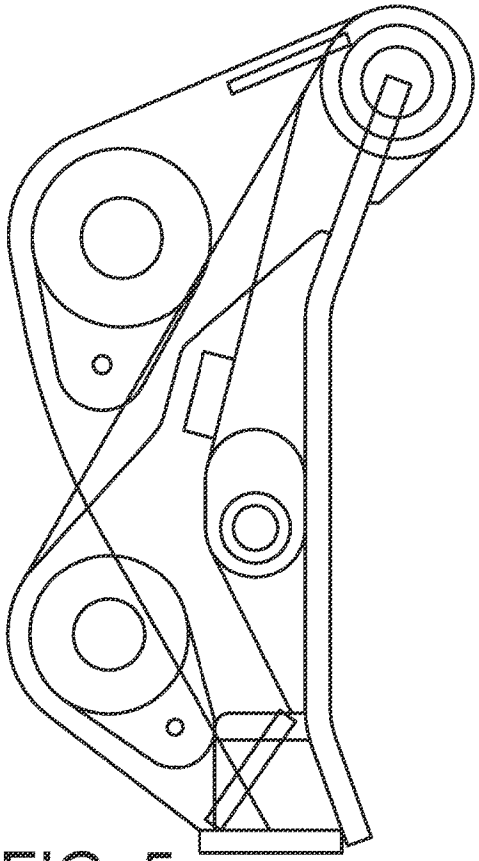
FIG. 5 is a side view of a prior art coupling device.

With reference to FIGS. 5 and 6, a prior art coupler is shown for comparison.

Figure 7:
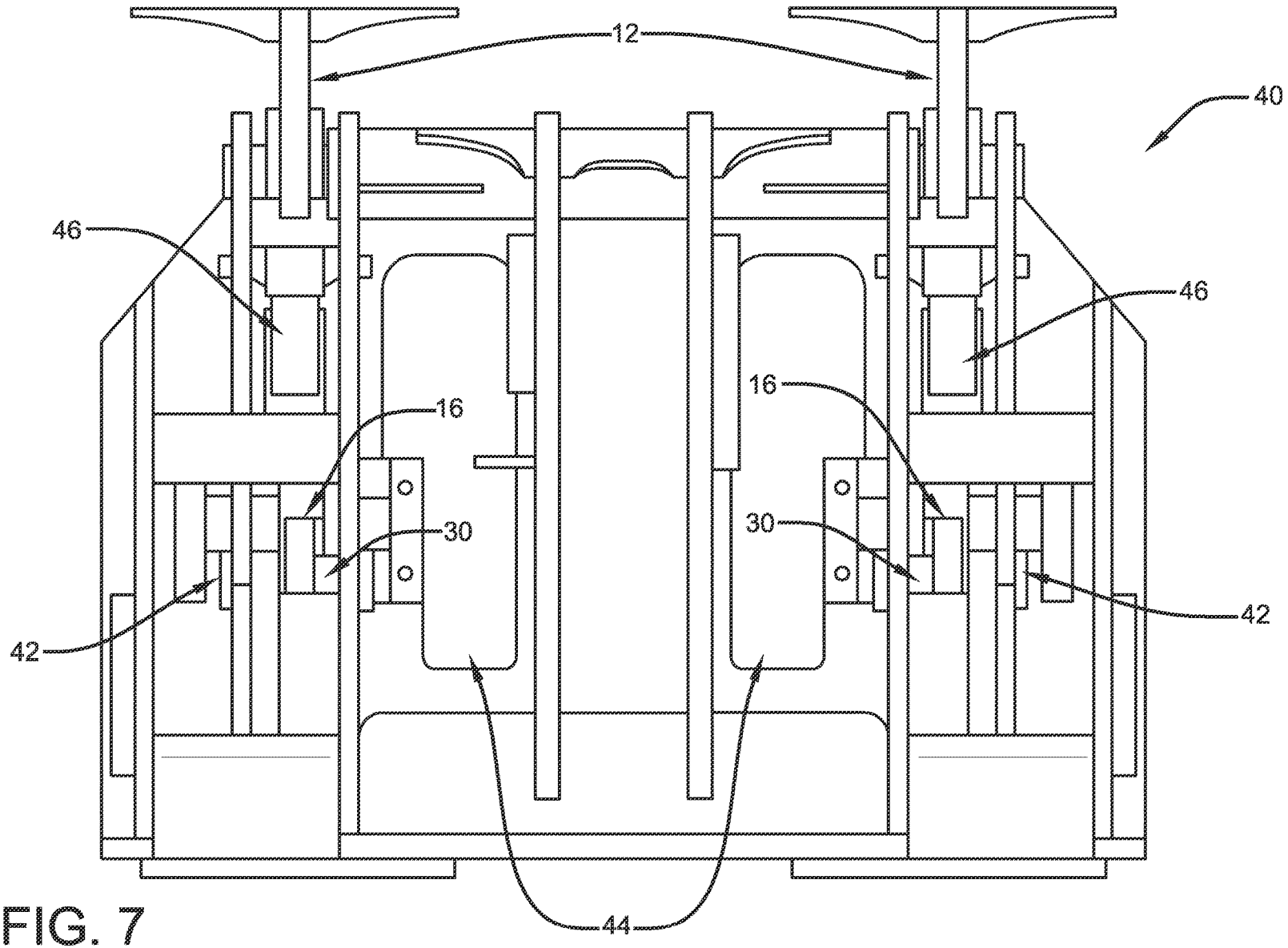
FIG. 7 is a rear view of the present coupling device, shown installed on the mounting bracket.

With reference to FIG. 7, a rear view of the present coupling apparatus 40 is shown partially installed on the mounting brackets 12. The coupling apparatus 40 can be permanently or semi permanently connected to the operating end of an associated construction vehicle, such as a wheel loader, through standard and known means, including hydraulic systems that allow for rotation of the coupling apparatus 40, and by extension, an implement 10, about multiple axes according to the desired application.

The coupling apparatus 40 can include a series of cutouts. The first set of cutouts 42 are adapted to allow the arm 16 and adaptor 30 to extend through the face of the coupling apparatus 40 for engagement therein. The second set of cutouts 44 can reduce weight of the coupling apparatus 40 and can provide a better line of sight for the operator to allow the operator to see the load and/or implement during operation. When the coupling apparatus 40 is installed on the mounting brackets 12 of the implement 10, the operator can then activate a series of hydraulic cylinders 46, typically arranged in a configuration of one per mounting bracket 12, which in turn can cause a wedge or clamp to securely engage the adaptor 30 on each mounting bracket 12, thus attaching the implement 10 to the coupling apparatus 40.

According to the described aspect, the adaptor 30 serves to convert the industry standard configuration into a vertical clamp/wedge. The adaptor 30 is semi-permanently installed through the opening 18 and can thereby eliminate the movement between the prior art pins and the prior art openings, which in turn eliminates the wear on each and prevents the failure of the equipment. Additionally, because the adaptor 30 consists of a pin 32, threaded pin 34, and cap bolt 36 which extends through the opening 18, the adaptor 30 can be retro-fit to existing implements without the need to modify the implement or purchase additional, expensive equipment. Further, because of the nature of the adaptor 30, it can be rapidly installed with minimal equipment, thereby reducing and/or eliminating downtime for the vehicle and operator. Furthermore, as the adaptor 30 and coupling apparatus 40 work in conjunction with the prior art implements 10, there is no need for additional training and or operational adjustments, which also can reduce downtime.

According to other aspects, implements can be developed wherein the mounting bracket includes a permanently installed adaptor for use with the present system.

According to another aspect, the coupling apparatus 40 can include appropriate hydraulic mounts to allow for the end operator to selectively attach a horizontal hydraulic system capable of engaging prior art implements without the adaptor.

According to another aspect, the coupling apparatus 40 can include removable, interchangeable wedges that can allow coupling to other prior art implements utilizing the second design described herein.

According to other aspects, the adaptor 30 can be a one-piece bar that can be permanently welded or otherwise affixed to the arm 16.

In one aspect of the disclosure, the mounting brackets 12 and arms 16 of the implement can be spaced about 30.62 inches apart, measured from the center of the bracket, corresponding to an industry standard JRB 416 size.

In other aspects, the mounting brackets 12 and arms 16 of the implement can be spaced about 32.75 inches apart, measured from the center of the bracket, corresponding to an industry standard JRB 418 size.

In other aspects, the mounting brackets 12 and arms 16 of the implement can be spaced about 29.00 inches apart, measured from the center of the bracket, corresponding to an industry standard JRB 420 size.

According to one aspect, coupler 40 is adapted to accommodate JRB 416 sized implements. In some aspects, the cutouts 42 are spaced apart to allow extension of arms 16, in a JRB 416 size configuration, corresponding to a mounting bracket spaced distance of approximately 30.62 inches, though the face of the coupling apparatus 40.

According to one aspect, coupler 40 is adapted to accommodate JRB 418 sized implements. In some aspects the cutouts 42 are spaced apart to allow extension of arms 16, in a JRB 418 size configuration, corresponding to a mounting bracket spaced distance of approximately 32.75 inches, though the face of the coupling apparatus 40.

According to one aspect, coupler 40 is adapted to accommodate JRB 420 sized implements. In some aspects, the cutouts 42 are spaced apart to allow extension of arms 16, in a JRB 420 size configuration, corresponding to a mounting bracket spaced distance of approximately 29.00 inches, though the face of the coupling apparatus 40.

According to one aspect, coupler 40 is adapted to accommodate implements in JRB 416, 418 and 420 size configurations, corresponding to a mounting bracket spaced distances of approximately 30.62 inches, 32.75 inches, and 29.00 inches, respectively According to one aspect, the first set of cutouts 42 are spaced apart to accommodate multiple and varying JRB sized implements. In some aspects, the cutouts 42 are spaced apart to allow extension of arms 16 though the face of the coupling apparatus 40 in all JRB 416, 418 and 420 size configurations, corresponding to a mounting bracket spaced distances of approximately 30.62 inches, 32.75 inches, and 29.00 inches, respectively.

According to one aspect, the coupler 40 is adjustable to accommodate implements in JRB 416, 418 and 420 size configurations, corresponding to a mounting bracket spaced distances of approximately 30.62 inches, 32.75 inches, and 29.00 inches, respectively.

As described above, the present disclosure has been described with preferred embodiments thereof and it is understood that many changes and modifications to the described aspects can be carried out without departing from the scope and the spirit of the present disclosure that is intended to be limited only by the appended claims.

It is now claimed:

1. An adaptor for an implement comprising:

a pin; wherein the pin further defines a first opening, a threaded pin; wherein the threaded pin further defines a second opening and a cap bolt;

wherein the pin is installed on an outer side of a lower mounting bracket of an implement to be secured; wherein the threaded pin is installed on an inner side of the lower mounting bracket of the implement to be secured and the second opening in the threaded pin is sized to accept at least a portion of the cap bolt; and wherein the cap bolt is inserted through the pin and into the threaded pin and secured thereto thus securing the attachment of the pin and threaded pin to the lower mounting bracket of the implement, wherein at least one of the pin or the threaded pin are welded to the lower mounting bracket.

2. The adaptor of claim 1 wherein the pin is permanently connected to the lower mounting bracket.

3. The adaptor of claim 2 wherein the pin is welded to the lower mounting bracket.

4. The adaptor of claim 1 wherein the threaded pin is permanently connected to the lower mounting bracket.

5. The adaptor of claim 4 wherein the threaded pin is welded to the lower mounting bracket.

6. The adaptor of claim 1 wherein the pin and the threaded pin are permanently connected to the lower mounting bracket.

7. The adaptor of claim 6 wherein the pin and the threaded pin are welded to the lower mounting bracket.

8. A coupling apparatus comprising:

an arrangement for attaching the coupler to an associated vehicle on a first side;

at least one hydraulic cylinder;

at least one hydraulically driven wedge; and, a first cutout and a second cutout;

wherein the at least one hydraulic cylinder drives the at least one wedge between an upper mounting bracket and an adaptor installed in a lower mounting bracket of an implement to be secured; the adaptor comprising:

a pin; wherein the pin further defines a first opening, a threaded pin; wherein the threaded pin further defines a second opening and a cap bolt;

wherein the pin is installed on the outer side of a lower mounting bracket of an implement to be secured; wherein the threaded pin is installed on the inner side of the lower mounting bracket of the implement to be secured and the second opening in the threaded pin is sized to accept at least a portion of the cap bolt; and wherein the cap bolt is inserted through the pin and into the threaded pin and secured thereto thus securing the attachment of the pin and threaded pin to the lower mounting bracket of the implement.

9. The coupling apparatus of claim 8 further comprising at least two hydraulic cylinders.

10. The coupling apparatus of claim 9 further comprising at least two hydraulically driven wedges.

11. The coupling apparatus of claim 8 further comprising a third and fourth cutout.

12. The coupling apparatus of claim 11 further comprising at least two hydraulic cylinders.

13. The coupling apparatus of claim 12 further comprising at least two hydraulically driven wedges.

14. A coupling apparatus comprising:

an arrangement for attaching the coupler to an associated vehicle on a first side;

at least two hydraulic cylinders;

at least two hydraulically driven wedges;

a first cutout;

a second cutout;

a third cutout; and a fourth cutout;

wherein the at least two hydraulic cylinders drive the at least two wedges between a first upper mounting bracket and a first adaptor installed in a first lower mounting bracket of an implement to be secured and a second upper mounting bracket and a second adaptor installed in a second lower mounting bracket of the implement to be secured; the adaptors each comprising:

a pin; wherein the pin further defines a first opening, a threaded pin; wherein the threaded pin further defines a second opening and a cap bolt, wherein the first pin is installed on the outer side of the first lower mounting bracket of an implement to be secured; wherein the first threaded pin is installed on the inner side of the first lower mounting bracket of the implement to be secured and the second opening in the first threaded pin is sized to accept at least a portion of the first cap bolt; and wherein the first cap bolt is inserted through the first pin and into the first threaded pin and secured thereto thus securing the attachment of the first pin and first threaded pin to the first lower mounting bracket of the implement; and wherein the second pin is installed on the outer side of the second lower mounting bracket of an implement to be secured; wherein the second threaded pin is installed on the inner side of the second lower mounting bracket of the implement to be secured and the second opening in the second threaded pin is sized to accept at least a portion of the second cap bolt; and wherein the second cap bolt is inserted through the second pin and into the second threaded pin and secured thereto thus securing the attachment of the second pin and second threaded pin to the second lower mounting bracket of the implement.

* * * * *